US005664264A

United States Patent [19]

Duero

[11] Patent Number: 5,664,264

[45] Date of Patent: Sep. 9, 1997

[54] SHOWER ENCLOSURE ASSEMBLY SYSTEM

[75] Inventor: Steven J. Duero, Waubeka, Wis.

[73] Assignee: Kohler Co., Kohler, Wis.

[21] Appl. No.: 659,846

[22] Filed: Jun. 7, 1996

[51] Int. Cl.[6] ..... A47K 3/22

[52] U.S. Cl. ..... 4/614; 4/612; 52/656.9; 52/656.2

[58] Field of Search ..... 4/607, 610, 612, 4/613, 614, 557; 52/656.2, 656.4, 656.9, 204.1

[56] References Cited

U.S. PATENT DOCUMENTS

| | | | |
|---|---|---|---|
| 283,506 | 8/1883 | Pardee et al. . | |
| 747,854 | 12/1903 | Clark . | |
| 2,065,531 | 12/1936 | Kerr | 4/612 |
| 2,783,860 | 3/1957 | Taubman | 4/607 |
| 3,407,561 | 10/1968 | Peacock | 52/656.9 |

FOREIGN PATENT DOCUMENTS

| | | | |
|---|---|---|---|
| 2235232 | 2/1991 | United Kingdom | 4/612 |

*Primary Examiner*—Henry J. Recla
*Assistant Examiner*—Charles R. Eloshway
*Attorney, Agent, or Firm*—Quarles & Brady

[57] ABSTRACT

A system for attaching two parts of a shower enclosure together which eliminates screw type fasteners and affords ease of fastening. The system includes a locking bar positioned in a cavity of a shower enclosure structural member wherein the bar can move transversely on the upper surface of another shower enclosure member when in a first position but when in a second position the bar restrains transverse movement. In a preferred embodiment, the locking bar is rotated on its longitudinal axis to the second position to cause the locking bar to deform a portion of the upper surface as well as move past and be retained in an overcenter position.

8 Claims, 3 Drawing Sheets

SHOWER ENCLOSURE ASSEMBLY SYSTEM

BACKGROUND OF THE INVENTION

A. Field of the Invention

This invention relates to a system for connecting structural components of a shower enclosure, wherein the connector can be easily manipulated to quickly fasten components or disconnect them.

B. Description of the Prior Art

In the construction of shower enclosures, it is necessary to connect several components together, such as the door jamb to the header. While screws or bolts are often used for this purpose, this poses problems in some instances where access is not readily available to make the necessary connections.

Thus a need exists for a connector wherein specific orientation with a fastening tool is obviated.

SUMMARY OF THE INVENTION

In one embodiment, the invention provides a system for attaching two parts of a shower enclosure together. A first shower enclosure structural member has an upper surface that is at least somewhat deformable. A second shower enclosure structural member is positioned at least partially over the upper surface, the second member having a cavity. A locking bar is positioned in the cavity over the upper surface and has a portion with a non-circular cross-section. The first and second members and locking bar are configured and juxtaposed such that when the locking bar is in a first position in the cavity the second member may move transversely on the upper surface, and such that when the locking bar is in a second position the bar restrains transverse movement of the second member relative to the first.

In one aspect, the locking bar is moved from the first position to the second position by rotating on its longitudinal axis.

In a preferred embodiment, when the bar is in the second position an edge of the bar deforms a portion of the upper surface of the first member.

In a preferred form, the cavity has spaced apart cutout sections that once the bar is in the second position, the cavity restrains movement of the bar.

In another preferred form, the cavity has a wall section configured and juxtaposed such that when the bar is in the second position and the edge of the bar deforms a portion of the upper surface of the first member, an overcenter condition is effected with respect to a rotation of the bar.

In yet another preferred form, the first shower enclosure includes a roller track and an access port for access to the bar by a tool.

The objects of the invention therefore include:

a. providing a system of the above kind which affords ease of fastening and removal;

b. providing a system of the above kind which employs few component parts;

c. providing a system of the above kind which has a unidirectional locking feature; and d. providing a connector of the above kind which can be produced at low cost and used where access is restricted.

These and still other objects and advantages of the invention will be apparent from the description which follows. In the detailed description below, a preferred embodiment of the invention will be described with reference to the accompanying drawings. The embodiment does not represent the full scope of the invention. Rather the invention may be employed in other embodiments. Thus, the claims should be looked to in order to judge the scope of the invention.

DESCRIPTION OF THE PREFERRED EMBODIMENT

Figure 1:
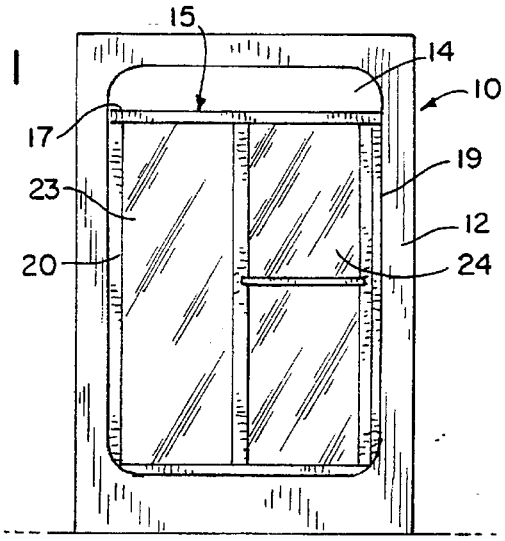
FIG. 1 is a perspective view of a shower enclosure which incorporates the present invention.

Referring to FIG. 1 there is shown a shower module, generally 10, which is located in a recess formed by the usual bathroom walls (not shown). The shower module includes a front wall portion 12 providing an entranceway 14 to the enclosure 10.

The entranceway 14 is closed by a slidable door system, generally 15, which includes a header 17 and side door jambs 19 and 20. Two glass doors or panels 23 and 24 are suspended from the header 17 which provides tracks for slidable panels 23 and 24.

Figure 2:
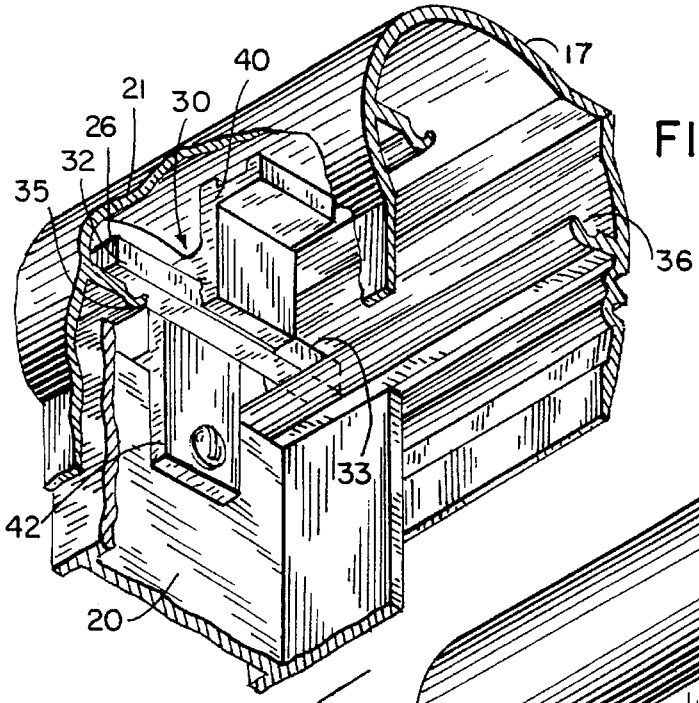
FIG. 2 is an enlarged perspective view of a portion of the shower enclosure shown in FIG. 1 with a portion broken away.
Figure 3:
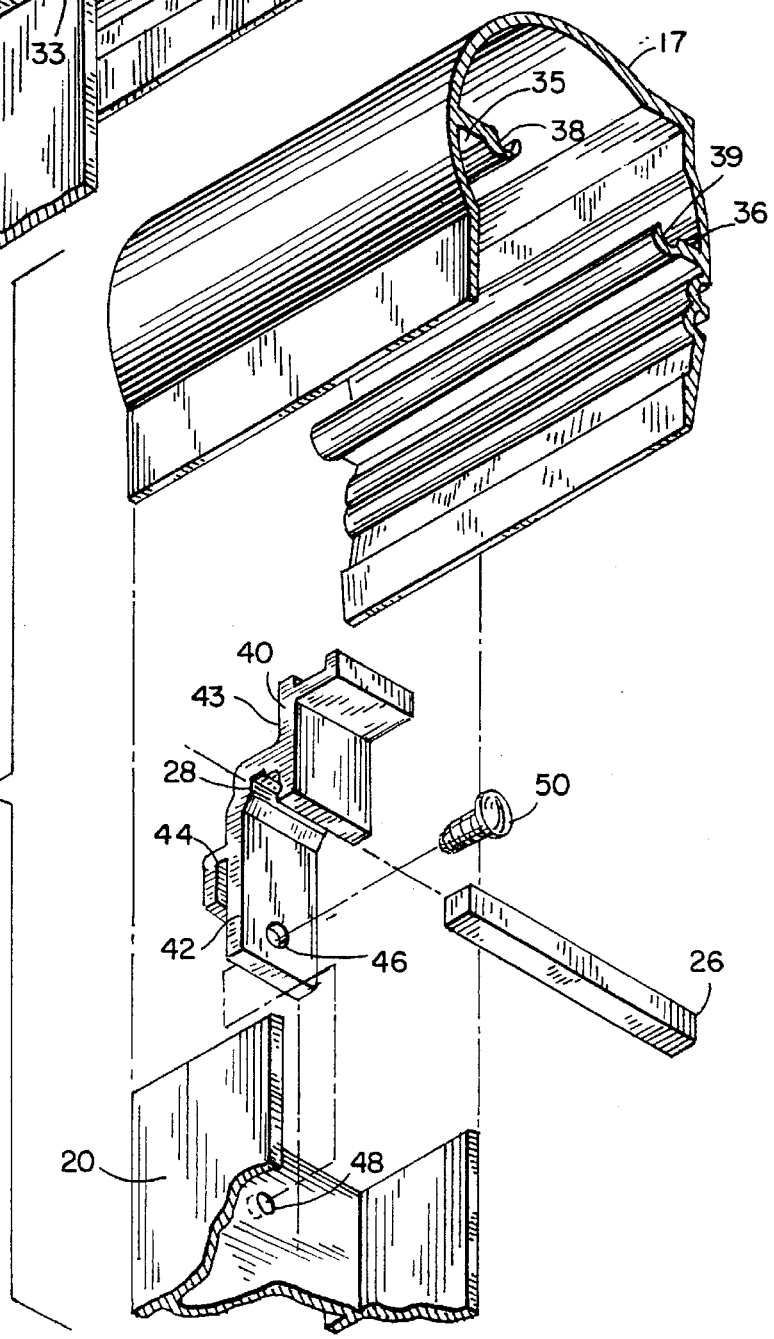
FIG. 3 is an exploded view of the component parts of the system shown in FIG. 2.

With particular reference to FIGS. 2 and 3, the enclosure assembly system, generally 30, is placed on the inside of header 17. The assembly system 30 includes a locking bar or key 26 which is square and non-circular in cross section and preferably composed of stainless steel. Locking bar 26 is received in cavity portion 28 of the shower enclosure structural member 40. Opposing end portions 32 and 33 of the locking bar 26 are seated on roller tracks 35 and 36 which extend laterally inward from header 17 and have channels 38 and 39 for accommodating rollers (not shown) rotatably connected to panels 23 and 24.

As best seen in FIG. 3, the structural member 40 has a downwardly extending leg section 42 with a slot 44 for receiving a portion of wall jamb 20. A hole 46 is disposed in leg section 42 and a threaded hole 48 in wall jamb 20 for securing the wall jamb 20 to the structural member 40 by the screw 50.

Figure 4:
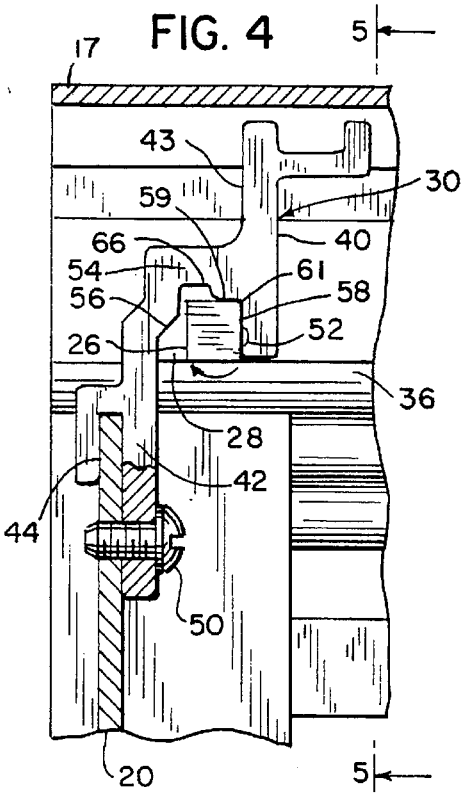
FIG. 4 is a cross sectional view of the connector shown in FIG. 2.
Figure 8A:
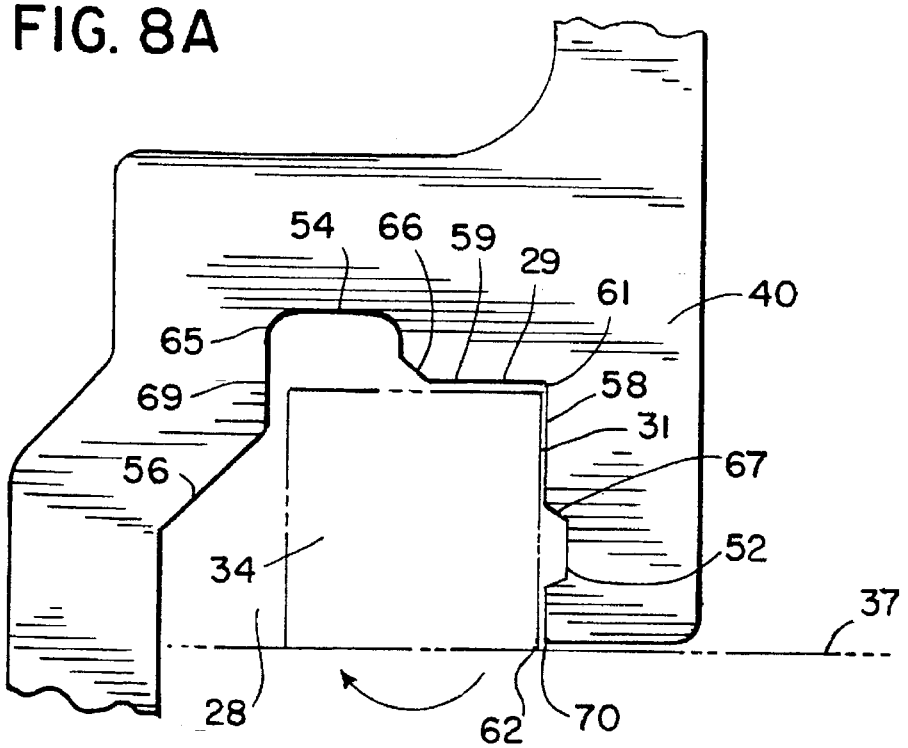
FIGS. 8A and 8B are enlarged fragmentary schematic views illustrating the different mode of operation shown in FIGS. 4 and 6, respectively.

FIGS. 4 and 8A illustrate the assembly system 30 as it is placed in the header 17 with the wall jamb 20 attached. In this position, it should be noted that the locking bar 26 is placed in the cavity portion 28 of the structural member 40 with two of its walls 29 and 31 orientated with wall sections 58 and 59 of the cavity portion 28 and corner portion 61 positioned in the corner of wall sections 58 and 59.

Figure 5:
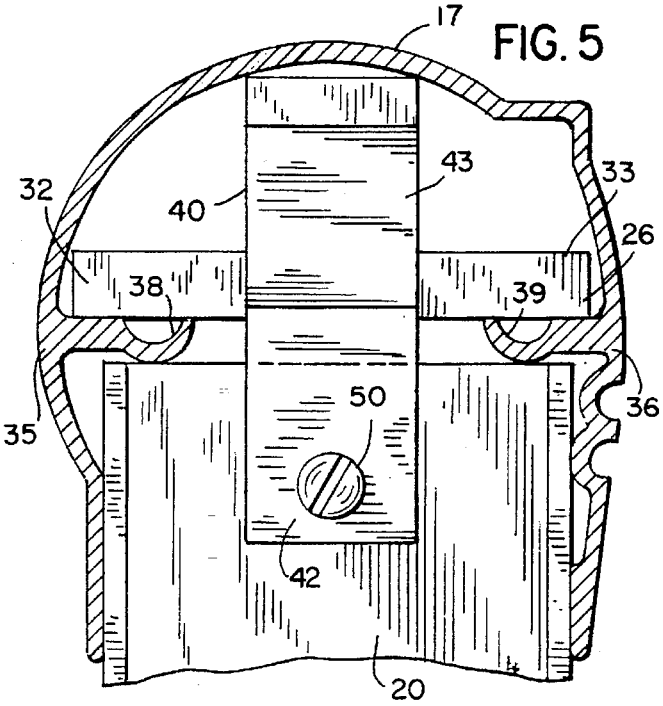
FIG. 5 is a sectional view taken along line 5—5 of FIG. 4.
Figure 6:
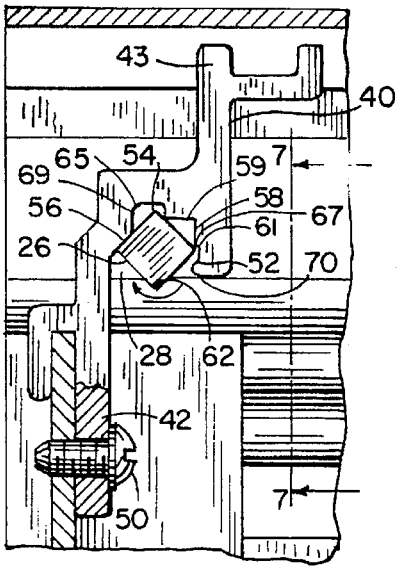
FIG. 6 is a sectional view, similar to FIG. 4, with the connector bar in a second "locking" position.
Figure 7:
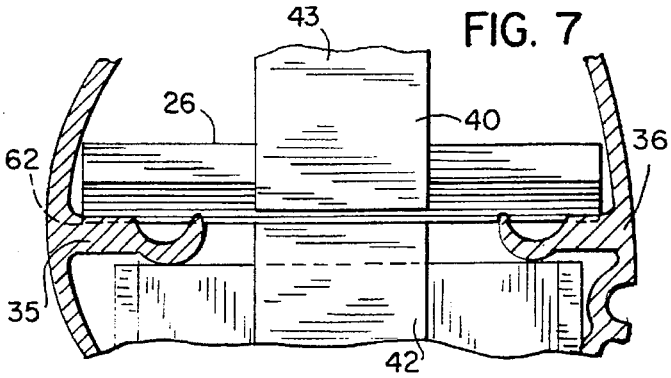
FIG. 7 is a sectional view taken along line 7—7 of FIG. 6.
Figure 8B:
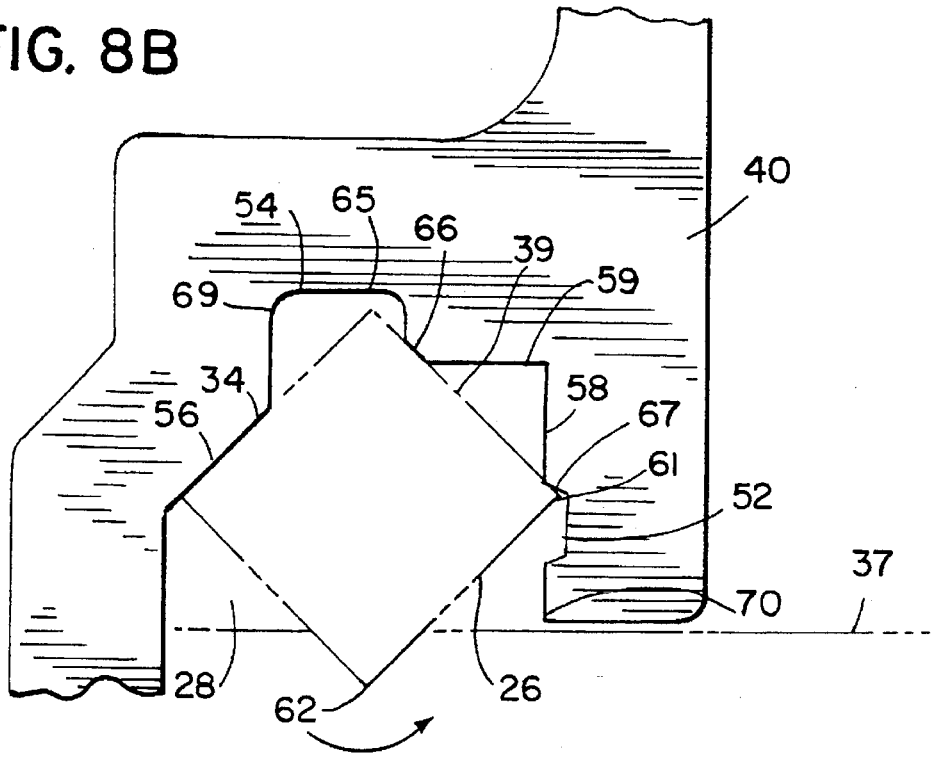

As seen in FIG. 5, structural member 40 is positioned between roller tracks 35 and 36 with opposing portions 32 and 33 of the locking bar 26 seated thereon. When it is desired to lock the structural member 40 and consequently the wall jamb 20 to the header 17, the locking bar 26 is rotated such as by a suitable wrench in a clockwise manner as shown by the directional arrows in FIGS. 4 and 8A. Access to the locking bar is afforded by an open access port 21 from the side of header 17 or from the bottom thereof, as seen in FIG. 2. Rotation is continued until corner portion 61 slides over ramp surface 67 extending between cutout 52 and wall section 58 and seats in cutout 52. In this position, another corner portion 62 of locking bar 26 will embed itself into roller tracks 35 and 36 which are composed of an aluminum metal. This is seen in FIGS. 6, 7 and 8B. In this position, and referring specifically to FIGS. 6 and 8B, another corner portion 65 of locking bar 26 is positioned in cutout 54, and one of the walls 34 of locking bar 26 is seated adjacent wall section 56 of cavity 28. Note also the contact in FIG. 5 between upper leg section 43 and header 17 to provide a rigid connection in addition to corner portion 62 embedded in and locally deforming roller tracks 38 and 39.

An important feature of the assembly system 30 is the design of the cavity 28 with its cutouts, wall portions and ramp. For example, as the locking bar 26 was rotated from the unlocked position of FIGS. 4 and 8A to the locked position of FIGS. 6 and 8B, surface 66 adjacent cutout 54 guides locking bar 26 as it is rotated in a clockwise manner to move over ramp surface 67 and position corner portion 61 in cutout 52 which acts as an indicator or click notch. Simultaneously, corner portion 65 will move into cutout 54. Ramp surface 67 is designed with a 30 degree angle between wall section 58 and cutout 52 and cutout 54 is sufficiently large to accommodate any movement of the locking bar 26 beyond the position shown in FIG. 8B.

Another important aspect is the design of wall section 56 with respect to the point where corner portion 62 embeds into the upper surface 37 of the roller tracks 36 as best illustrated in FIG. 8B. It is formed with an obtuse angle with respect to cutout 54 and wall section 69. In conjunction with the point where corner position 62 is fully embedded into surface 37, wall section 56 is positioned such that locking bar 26 can be rotated about five degrees beyond forty-five degrees (i.e. 50 degrees) as it is rotated along its longitudinal axis from the FIGS. 4 and 8A to the FIGS. 6 and 8B position. This effects an overcenter or spring back action of the locking bar 26 in the cavity 28 due to the torsion on locking bar 26.

Still other important features of cavity 28 and its relationship to locking bar 26 is the cutout 54 which provides a clearance envelope as the bar member is in the FIGS. 6 and 8B locked position. The wall section 69 of the cutout 54 and the wall section 70 adjacent cutout 52 also serve as a unidirectional control feature. When it is desired to unlock the locking bar 26 and move it from the FIGS. 6 and 8B position to the FIGS. 4 and 8A position, it can only be rotated in a counterclockwise position as shown by the directional arrow in FIGS. 6 and 8B. As seen in FIGS. 6 and 8B, any clockwise movement is blocked by wall section 56 and wall 34 of locking bar 26. Any counterclockwise movement beyond the FIGS. 4 and 8A position is blocked by wall sections 69 and 70.

It will thus be seen that there is now provided a connector which is easy to operate obviating orientation with a screw driver or the threading of a nut. The connector affords a hidden connection yet allows ease of operation. The connector employs only two component parts yet affords unidirectional control.

While a preferred embodiment has been described above, it should be readily apparent from this disclosure to those skilled in the art that a number of modifications may be made without departing from the spirit and scope of the invention. For example, in the previous description, there is shown a header 17 with roller tracks 35 and 36 for connecting with the connector 30. If desired, the connector could be utilized in conjunction with any structure which provides a contacting surface for frictional engagement with locking bar 26. Further, while locking bar 26 is depicted as square in configuration, other noncircular configurations could be used such as rectangular or pentagonal. However, these would require a different orientation of cutouts and different wall sizes in the cavity 28.

I claim:

1. A system for attaching two parts of a shower enclosure together, comprising:

a first shower enclosure structural member connected to a shower header and having an upper surface that is at least somewhat deformable;

a second shower enclosure structural member connected to a shower door jamb and positioned at least partially over said upper surface, said second member having a cavity; and a locking bar positioned in the cavity over the upper surface and having a portion with a non-circular cross-section;

the first and second members and locking bar being configured and juxtaposed such that when the locking bar is in a first position in the cavity the second member may move transversely on the upper surface, and such that when the locking bar is in a second position the bar restrains transverse movement of the second member relative to the first.

2. The system of claim 1, wherein to move from the first position of the locking bar to the second position of the bar the bar is rotated on its longitudinal axis.

3. The system of claim 1, wherein when the bar is in the second position an edge of the bar deforms a portion of the upper surface of the first member.

4. The system of claim 3, wherein the cavity has a wall section configured and juxtaposed such that when the locking bar is in the second position and the edge of the locking bar deforms a portion of the upper surface of the first member an overcenter condition is effected with respect to a rotation of the bar.

5. The system of claim 1, wherein the cavity has spaced apart cut-out sections such that once the locking bar is in the second position the cavity restrains movement of the locking bar.

6. The system of claim 1, wherein the first shower enclosure structural member includes a roller track and the upper surface forms a portion thereof.

7. The system of claim 6, wherein the first shower enclosure structural member includes an access port for access to the locking bar by a tool.

8. The system of claim 1, wherein the locking bar has an essentially square cross-section.

* * * * *